United States Patent [19]

Pieczykolan

[11] Patent Number: 4,609,047

[45] Date of Patent: Sep. 2, 1986

[54] QUICK RELEASE MECHANISM FOR SPRINKLER HEAD

[75] Inventor: George S. Pieczykolan, North Wales, Pa.

[73] Assignee: Central Sprinkler Corporation, Landsdale, Pa.

[21] Appl. No.: 635,767

[22] Filed: Jul. 30, 1984

[51] Int. Cl.[4] ..... A62C 37/14
[52] U.S. Cl. ..... 169/38
[58] Field of Search ..... 169/37–42

[56] References Cited

U.S. PATENT DOCUMENTS

| | | | |
|---|---|---|---|
| 842,725 | 1/1907 | Taylor | 169/38 |
| 1,273,387 | 7/1918 | Loepsinger | 169/38 |
| 1,450,219 | 4/1923 | Newton | 169/38 |
| 4,343,364 | 8/1982 | Glinecke | 169/42 X |

FOREIGN PATENT DOCUMENTS

| | | | |
|---|---|---|---|
| 867654 | 1/1953 | Fed. Rep. of Germany | 169/41 |
| 2342086 | 10/1977 | France | 169/38 |
| 12914 | of 1903 | United Kingdom | 169/38 |
| 251119 | 4/1926 | United Kingdom | 169/38 |

*Primary Examiner*—Joseph F. Peters, Jr.
*Assistant Examiner*—Mary Beth O. Jones
*Attorney, Agent, or Firm*—Seidel, Gonda, Goldhammer & Abbott

[57] ABSTRACT

A quick release mechanism for a sprinkler head comprises a frangible element and a heat expansible fluid contained therein. A thermally conductive element or heat sink extends through a wall of the frangible element. A portion of the heat sink is in contact with the expansible fluid and another portion of the heat sink is disposed outside the wall. The heat sink conducts heat from the outside of the frangible element to the heat expansible fluid within so as to accelerate expansion of the fluid and rupture of the frangible element.

8 Claims, 13 Drawing Figures

FIG. 1
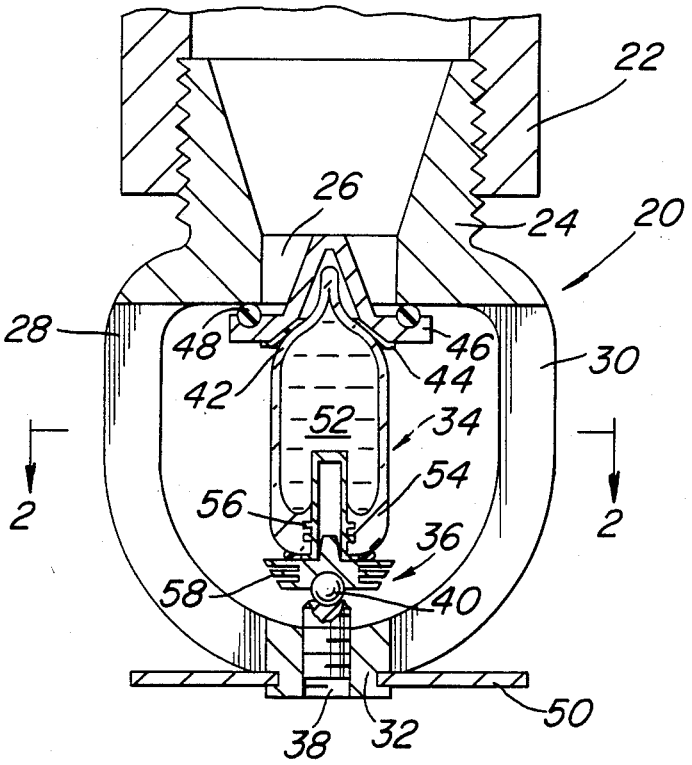
FIG. 3
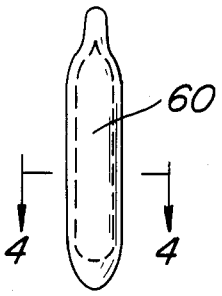
FIG. 4
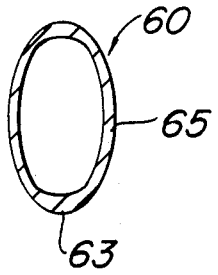
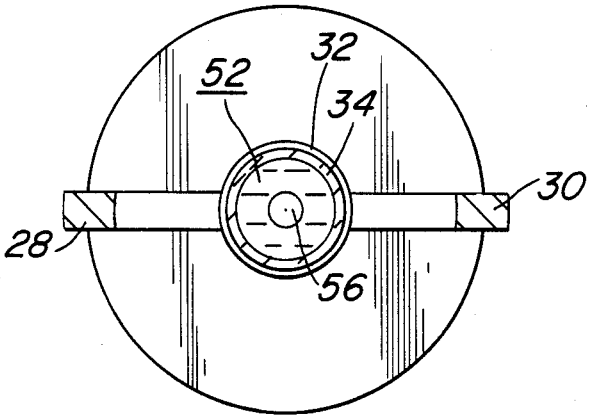
FIG. 2

FIG. 5
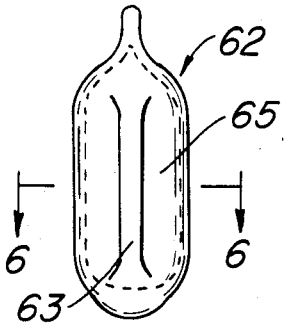
FIG. 6
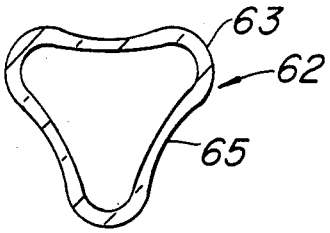
FIG. 9
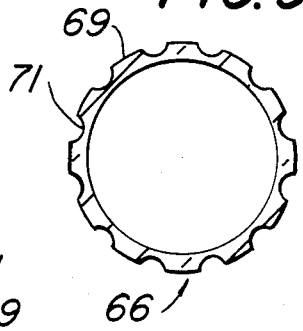
FIG. 7
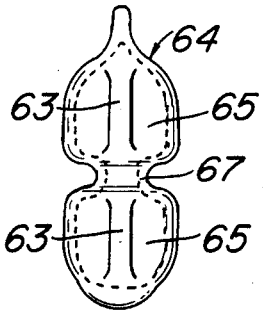
FIG. 8
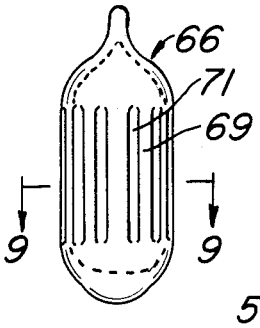
FIG. 10
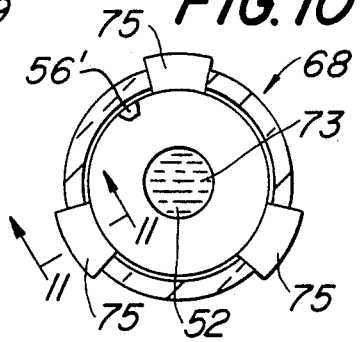
FIG. 11
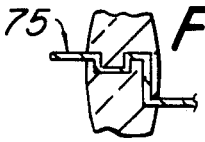
FIG. 12
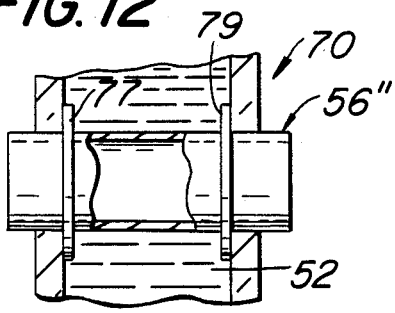
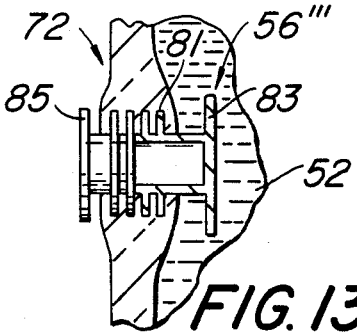
FIG. 13

QUICK RELEASE MECHANISM FOR SPRINKLER HEAD

BACKGROUND OF THE INVENTION

The present invention is directed to a quick release mechanism for a sprinkler head which may be used, for example, to extinguish a fire. A conventional release mechanism for a sprinkler head comprises a frangible bulb-shaped element adapted to contain a heat expansible fluid. The frangible element is a thermal insulator such as glass. Heat is transferred from the surrounding environment through a wall of the glass element to the heat expansible fluid in the interior of the element. The heat transfer causes the fluid to expand so as to exert pressure on the inside of the wall and eventually rupture the wall. When the element ruptures, a cap for the sprinkler head orifice or outlet port drops away so that pressurized fluid such as water can pass through the port.

The conventional glass element, being a thermal insulator, retards heat transfer to the expansible fluid within the element. It may take as long as three minutes for the expansible fluid to be heated to a degree such that sufficient pressure is developed within the glass element to rupture the element.

It is an object of the present invention to provide a quick release mechanism wherein the expansible fluid is heated relatively rapidly so as to achieve rupture of the frangible element in a fraction of the time required to rupture the conventional release mechanism.

It is another object of the invention to provide a quick release mechanism which can withstand conventional compressive loading forces when installed in the sprinkler head.

It is a further object of the invention to provide a quick release mechanism which is easily installed in the sprinkler head.

It is a further object of the invention to provide a quick release mechanism which is simple and reliable.

Other objects and advantages of the invention appear hereinafter.

BRIEF SUMMARY OF THE INVENTION

Quick release mechanism for a sprinkler head which comprises a frangible element and a heat expansible fluid contained therein. A thermally conductive element or heat sink extends through and in contact with the wall of the frangible element. The heat sink has a first portion which is disposed within the interior of the frangible element so as to contact the heat expansible fluid and a second portion which is disposed outside the frangible element.

The quick release mechanism is installed in a sprinkler head which is provided with an orifice or fluid outlet port. A cap is supportably mounted on the frangible element and is disposed in juxtaposition with the outlet port so as to releasably seal the port. Loading means loads the frangible element in supporting relation with respect to the cap so as to maintain the cap in sealing relation with respect to the outlet port.

For the purpose of illustrating the invention, there is shown in the drawings various forms which are presently preferred; it being understood, however, that this invention is not limited to the precise arrangements and instrumentalities shown.

BRIEF DESCRIPTION OF THE DRAWINGS

FIG. 1 is a section of a preferred embodiment of the quick release mechanism of the present invention installed in a sprinkler head.

FIG. 2 is a plan section taken along 2—2 in FIG. 1.

FIG. 3 is an elevation of an alternative embodiment of the frangible element, the heat sink being omitted for clarity.

FIG. 4 is a section taken along 4—4 in FIG. 3.

FIG. 5 is an elevation of another embodiment of the frangible element, the heat sink being omitted for clarity.

FIG. 6 is a section taken along 6—6 in FIG. 5.

FIG. 7 is an elevation of a further embodiment of the frangible element, the heat sink being omitted for clarity.

FIG. 8 is an elevation of a further embodiment of the frangible element, the heat sink being omitted for clarity.

FIG. 9 is a section taken along 9—9 in FIG. 8.

FIG. 10 is a plan section of another embodiment of a frangible element and heat sink.

FIG. 11 is a partial section taken along 11—11 in FIG. 10.

FIG. 12 is a partial section in elevation of another embodiment of a frangible element and heat sink.

FIG. 13 is a partial section in elevation of a further embodiment of a frangible element and heat sink.

DETAILED DESCRIPTION OF THE INVENTION

Referring to the drawings, wherein like numerals indicate like elements, there is shown in FIG. 1 a sprinkler head 20 which is threadedly secured to a pipe 22 by means of a threaded connector portion 24. Pressurized fluid such as water is conducted through the pipe to a conical mouth formed by the interior surface of connector portion 24. The conical mouth is in fluid communication with an orifice or outlet port 26 defined by a cylindrical interior surface of portion 24.

The sprinkler head 20 is provided with arms 28, 30. The arms extend between connector portion 24 and a hub 32. Hub 32 is provided with a threaded bore which receives a threaded load screw 38 described in fuller detail hereafter. A deflector plate 50 is mounted in a groove on the hub.

The quick release mechanism of the present invention comprises a bulb-shaped frangible element 34 which contains a heat expansible fluid 52. Preferably, the fluid is alcohol or a fluid mixture which comprises alcohol. A cap 46 having a circular flange and a conical shaped central portion is disposed in juxtaposition with port 26. The port is sealed by the cap and a silicone O-ring 48. Cap 46 is mounted on the top of the frangible element. Preferably, the cap does not directly contact the frangible element but instead contacts a mylar washer 44 which cushions the compressive load on element 34, and acts as a thermal insulator.

Frangible element 34 is provided with a thermally conductive element or heat sink 56, preferably copper, which extends through the bottom portion of the frangible element. A portion of heat sink 56 is disposed within the interior of the frangible element so as to contact the heat expansible fluid. The medial portion of the heat sink 56 is embedded in the wall of the frangible element and is provided with one or more annular fins which help to seal the interior of the frangible element. Another portion of the heat sink 56 is disposed outwardly of the bottom portion of the frangible element so as to be exposed to the surrounding air.

Heat sink 56 is seated on and supported by another thermally conductive element or heat sink 36, also preferably copper. Heat sink 36 is provided with one or more annular fins 58. Heat sink 36 is mounted on a ball-shaped thermal insulator 40, preferably made of glass. Ball 40 is seated in a depression formed at the top of load screw 38.

To load the quick release mechanism in sprinker head 20 such that cap 46 seals port 26, load screw 38 is threaded in hub 32 so as to exert a compressive loading force on the frangible element. The wall thickness of the frangible element is chosen so as to withstand the compressive loading force required to seal port 26 while insuring that the wall will rupture under heat as fluid 52 expands within the interior of the frangible element.

Preferably, the thermal conductivity coefficient ("TCC") of the elements of the quick release mechanism are as follows:

| Element | TCC* |
|---|---|
| 40 | <5 |
| 36 | >226 |
| 56 | >226 |
| 34 | <5 |
| 44 | <10 |

*BTU/hour/ft$^2$/°F./ft

Frangible element 34 may have a circular cross-section as shown in FIG. 2. Alternatively, the cross-section of the frangible element may be oval-shaped as shown in FIGS. 3 and 4 wherein the frangible element is designated 60.

The cross-section of the wall of the frangible element may also be triangular-shaped as shown in FIGS. 5 and 6 wherein the frangible element is designated 62. For this embodiment of the frangible element, and the one depicted in FIGS. 3 and 4, the wall thickness is increased at rib portions 63 and decreased at connecting portions 65 to facilitate rupture of the frangible element along connecting portions 65 as the heat expansible fluid expands within the interior of the frangible element. The rib portions 63 provide mechanical strength so as to withstand the compressive loading force exerted by load screw 38.

The frangible element shown in FIGS. 5 and 6 may be modified so as to assume the hour-glass shape shown in FIG. 7 wherein the frangible element is designated 64. For this embodiment of the frangible element, the upper and lower portions of the element are joined by a neck portion 67. The neck portion is hollow so as to permit fluid communication between the upper and lower interior portions of the frangible element.

The frangible element may also be shaped as shown in FIGS. 8 and 9 wherein the element is designated 66. For this embodiment of the frangible element, the wall is generally circular in cross-section but the wall is thicker at rib portions 69 and thinner at groove portions 71. As in the embodiments shown in FIGS. 5–7, the thinner wall portions insure that the frangible element will rupture as the heat expansible fluid expands within the interior of the element, and the thicker wall portions provide mechanical strength for withstanding the compressive loading force exerted by load screw 38.

Each of the embodiments of the frangible element shown in FIGS. 3–9 may be provided with a heat sink 56 in the form and location shown in FIG. 1 wherein the heat sink 56 is located at the bottom portion of the frangible element. For this arrangement, the heat sink is mounted on second heat sink 36 and ball 40 as already described.

Alternatively, a different form of heat sink may be employed for each frangible element shown in FIGS. 1–9, and the heat sink may be located at the top portion of the frangible element or at a medial portion of the frangible element. The bottom portion of the frangible element would then be closed and would seat directly in the depression formed in the top of load screw 38, and the second heat sink 36 and glass ball 40 would be dispensed with. An exemplary embodiment of such a frangible element and heat sink is shown in FIGS. 10 and 11 wherein the frangible element is designated 68 and the heat sink is designated 56'. In FIG. 10, the frangible element has the shape of element 34, as shown in FIGS. 1 and 2, although it should be understood that the frangible element may be generally shaped as shown in FIGS. 3–9 as well. Heat sink 56' is generally diskshaped having spaced fins 75 and a central opening 73 to accomodate passage of fluid 52. Fins 75 are embedded in the wall of the frangible element and are exposed outside the wall. The wall of the frangible element may be enlarged at the region of fins 75. Preferably, the fins are crimped as shown in FIG. 11 to help seal the interior of the frangible element.

A further embodiment of a frangible element and heat sink is shown in FIG. 12 wherein the frangible element is designated 70 and the heat sink is designated 56''. For this embodiment, heat sink 56'' is generally tubular and is located along a medial portion of the frangible element. The heat sink is provided with opened end portions which extend through diametrically opposed sections of the wall of the frangible element. Heat sink 56'' is provided with circular flanges 77, 79 which are bowed so as to conform to the curvature of the interior surface of the frangible element.

The frangible element and heat sink may also take the form shown in FIG. 13 wherein the frangible element is designated 72 and the heat sink is designated 56'''. For this embodiment, the heat sink is generally tubular and located along a medial portion of the frangible element. The heat sink is provided with one or more annular fins 81 embedded in the element wall which help to seal the interior of the element. The wall of the frangible element may be enlarged at the region of fins 81. One end of heat sink 56''' is closed and is provided with a circular flange 83 disposed within the interior of the frangible element. The other end of the heat sink is open and is provided with a circular fin 85 which is disposed outwardly of the frangible element.

In operation, heat outside the frangible element (generated for example by fire) is conducted by heat sink 56 (56', 56'', 56''') to the interior of the frangible element. The portion of the heat sink which is disposed within the interior of the frangible element contacts the heat expansible fluid and transfers heat directly to the fluid. As the fluid expands, pressure is developed within the interior of the frangible element until the wall of the frangible element ruptures. The frangible element therefore drops away from cap 46, and the cap drops away from port 26. Pressurized fluid such as water then flows through pipe 22 and port 26 to the surrounding environment, for example, to extinguish a fire.

The present invention may be embodied in other specific forms without departing from the spirit or essential attributes thereof and, accordingly, reference should be made to the appended claims, rather than to the foregoing specification, as indicating the scope of the invention.

I claim:

1. Sprinkler head provided with a fluid outlet port, comprising:

(a) a frangible element and heat expansible fluid contained therein, (b) a thermally conductive element extending through a wall portion of said frangible element, (c) said thermally conductive element having a first portion disposed within the interior of the frangible element so as to contact said heat expansible fluid and a second portion disposed outside the frangible element and exposed to surrounding air such that the thermally conductive element conducts heat from the surrounding air to said heat expansible fluid so as to cause the fluid to expand and rupture the frangible element, (d) a cap supportably mounted on said frangible element and disposed in juxtaposition with the fluid output port so as to releasably seal said fluid outlet port, and (e) loading means for loading said frangible element under compression so as to maintain said cap in sealing relation with said outlet port and including a thermally conductive support member disposed so as to contact said second portion of said thermally conductive element outside said frangible element.

2. Sprinkler head according to claim 1 wherein said loading means includes means for adjustably loading said frangible element under compression.

3. Sprinkler head according to claim 2 wherein said means for adjustably loading said frangible element includes a load screw adapted to be threadedly secured to said sprinkler head, and a glass ball in contact with said load screw and said thermally conductive support member.

4. A sprinkler head provided with a fluid outlet port, comprising:

(a) a frangible element and heat expansible fluid contained therein, (b) a thermally conductive element extending through a wall portion of said frangible element, (c) said thermally conductive element having a first portion disposed within the interior of the frangible element so as to contact said heat expansible fluid and a second portion disposed outside the frangible element and exposed to surrounding air such that the thermally conductive element conducts heat from the surrounding air to said heat expansible fluid so as to cause the fluid to expand and rupture the frangible element, (d) a cap supportably mounted on said frangible element and disposed in juxtaposition with the fluid outlet port so as to releasably seal said fluid outlet port, (e) a thermally conductive support member disposed so as to contact said second portion of said heat conductive element outside said frangible element, (f) a load screw adapted to be threadedly secured to said sprinkler head, and (g) a glass ball in contact with said load screw and said thermally conductive support member.

5. Sprinker head according to claim 4 wherein said thermally conductive element is made of copper.

6. Sprinkler head according to claim 4 wherein the thermal conductivity coefficient of said thermally conductive element is approximately 226 BTU/hour/ft$^2$/°F./ft.

7. Sprinkler head according to claim 4 wherein the thermal conductivity coefficient of said frangible element is less than 5 BTU/hour/ft$^2$/°F./ft.

8. Sprinkler head according to claim 4 wherein said heat expansible fluid comprises alcohol.

* * * * *